US008322004B2

(12) United States Patent
Lewis et al.

(10) Patent No.: US 8,322,004 B2
(45) Date of Patent: Dec. 4, 2012

(54) INDIRECT LASER INDUCED RESIDUAL STRESS IN A FUEL SYSTEM COMPONENT AND FUEL SYSTEM USING SAME

(75) Inventors: Stephen R. Lewis, Chillicothe, IL (US); Alan R. Stockner, Metamora, IL (US); Dennis H. Gibson, Chillicothe, IL (US); Marion B. Grant, Jr., Princeville, IL (US); Avinash R. Manubolu, Edwards, IL (US)

(73) Assignee: Caterpilar Inc., Peoria, IL (US)

( * ) Notice: Subject to any disclaimer, the term of this patent is extended or adjusted under 35 U.S.C. 154(b) by 507 days.

(21) Appl. No.: 12/432,072

(22) Filed: Apr. 29, 2009

(65) Prior Publication Data

US 2010/0276520 A1 Nov. 4, 2010

(51) Int. Cl.
*B21C 37/30* (2006.01)
*B21D 51/16* (2006.01)
*B21D 53/76* (2006.01)

(52) U.S. Cl. ..... 29/90.7; 29/890.14; 29/890.1; 239/533.2

(58) Field of Classification Search ..... 29/90.7, 29/890.12, 890.121, 890.122, 890.124–890.126, 29/890.13, 890.14–890.143, 890.147–890.149
See application file for complete search history.

(56) References Cited

U.S. PATENT DOCUMENTS

| | | | | |
|---|---|---|---|---|
| 3,805,015 | A * | 4/1974 | Herziger et al. | 219/121.7 |
| 4,017,708 | A | 4/1977 | Engel et al. | |
| 4,093,842 | A | 6/1978 | Scott | |
| 4,617,070 | A | 10/1986 | Amende et al. | |
| 4,937,421 | A * | 6/1990 | Ortiz et al. | 219/121.68 |
| 5,072,092 | A | 12/1991 | Richter et al. | |
| 5,237,148 | A * | 8/1993 | Aoki et al. | 219/121.7 |
| 5,515,770 | A | 5/1996 | Clark et al. | |
| 5,531,570 | A | 7/1996 | Mannava et al. | |
| 5,744,781 | A | 4/1998 | Yeaton | |
| 6,070,813 | A * | 6/2000 | Durheim | 239/533.2 |
| 6,566,629 | B1 * | 5/2003 | Dulaney et al. | 219/121.74 |
| 6,592,690 | B1 | 7/2003 | Weis et al. | |
| 6,609,502 | B1 | 8/2003 | Frank | |
| 6,657,160 | B2 * | 12/2003 | Hackel et al. | 219/121.85 |
| 6,805,970 | B2 | 10/2004 | Hackel et al. | |
| 7,162,798 | B2 | 1/2007 | Westra | |
| 7,259,351 | B2 | 8/2007 | Lineton et al. | |
| 2004/0108306 | A1 | 6/2004 | Wiezbowski et al. | |
| 2004/0168494 | A1 | 9/2004 | Taudt | |
| 2004/0195350 | A1 | 10/2004 | Astachow et al. | |
| 2005/0005913 | A1 * | 1/2005 | Usui et al. | 123/468 |
| 2005/0025894 | A1 | 2/2005 | Ren et al. | |
| 2005/0127665 | A1 * | 6/2005 | Usui et al. | 285/197 |
| 2005/0156057 | A1 * | 7/2005 | Hamann et al. | 239/102.2 |
| 2008/0011391 | A1 | 1/2008 | Brenner et al. | |
| 2008/0053384 | A1 | 3/2008 | Haake et al. | |

FOREIGN PATENT DOCUMENTS

| | | |
|---|---|---|
| JP | 2005365502 | 12/2005 |
| JP | 2006322446 | 11/2006 |
| WO | WO 2005/054522 A1 | 6/2005 |

* cited by examiner

*Primary Examiner* — Len Tran
*Assistant Examiner* — Justin Jonaitis
(74) *Attorney, Agent, or Firm* — Liell & McNeil

(57) ABSTRACT

A metallic fuel system component includes an internal surface and an external surface. The metallic fuel system component is made by inducing compressive residual stress in only a portion of the internal surface of the metallic fuel system component by transmitting a laser shock wave through the metallic fuel system component from the external surface to the internal surface.

14 Claims, 3 Drawing Sheets

INDIRECT LASER INDUCED RESIDUAL STRESS IN A FUEL SYSTEM COMPONENT AND FUEL SYSTEM USING SAME

TECHNICAL FIELD

The present disclosure relates generally to fuel system components and, more particularly, to fuel system components having indirect laser induced residual stress.

BACKGROUND

Engineers are constantly seeking improved performance and expanded capabilities for fuel systems, while also seeking to reduce risks of structural damage, including cracks, occurring in fatigue sensitive locations of the fuel systems. For example, it has been shown that injection at higher fuel pressures may provide improved performance and efficiency. As a result, fuel system components should be manufactured to withstand these high fuel pressures, especially at locations subject to cyclic stresses, vibrations, and other fatigue causing stresses. For example, the SAC area of the fuel injector, which generally includes the volume underneath the needle check valve seat that opens to the nozzle orifices, may experience extreme fluctuations in pressure and flow forces during and between injection events. In another example, other fuel system components, including high pressure fuel lines, may experience substantial stress due to increased fluid operating pressures, and may also experience other fatigue inducing stresses, such as bending, due to engine vibrations and the like.

It has been shown that a number of surface treatments may improve fatigue life in components where failure may be caused by surface initiated cracks. For example, resistance to crack formation and general material strengthening may be obtained by the application of mechanical shot peening processes, autofrettaging, grinding operations, carburizing heat treatments, ultrasonic impact treatments, and other similar surface treatments. Such treatments, which are applied directly to the fatigue sensitive surface of the component, may effectively increase the fatigue strength of the component, as compared to otherwise untreated components. More recently, as shown in Japanese Patent Publication Number 2006322446, laser shock peening is being used to strengthen a surface of a component to a greater depth than that possible with conventional shot peening. Specifically, the cited reference teaches the use of laser shock peening to increase the strength of a conical seat surface at a branch hole of a fuel system common rail. However, while such strategies for material strengthening are known, many strategies are not available to address fatigue sensitive surfaces, such as those in fuel systems, that, due to size and/or location, may be inaccessible.

The present disclosure is directed to overcoming one or more of the problems set forth above.

SUMMARY OF THE DISCLOSURE

In one aspect, a metallic fuel system component includes an internal surface and an external surface. The metallic fuel system component is made by inducing compressive residual stress in only a portion of the internal surface of the metallic fuel system component by transmitting a laser shock wave through the metallic fuel system component from the external surface to the internal surface.

In another aspect, a fuel system component includes a component body having a metallic wall. The metallic wall defines an internal surface and an external surface separated by a first wall thickness of less than about three millimeters. The internal surface includes a compressive residual stress region that extends from the external surface to the internal surface.

In yet another aspect, a method of inducing compressive residual stress in an internal surface of a fuel system component includes directing a laser pulse at an external surface of the fuel system component. A laser shock wave is transmitted through a wall thickness of the fuel system component from the external surface through the internal surface. The laser shock wave is then received in a shock absorption material coupled with the internal surface.

DETAILED DESCRIPTION

Figure 1:
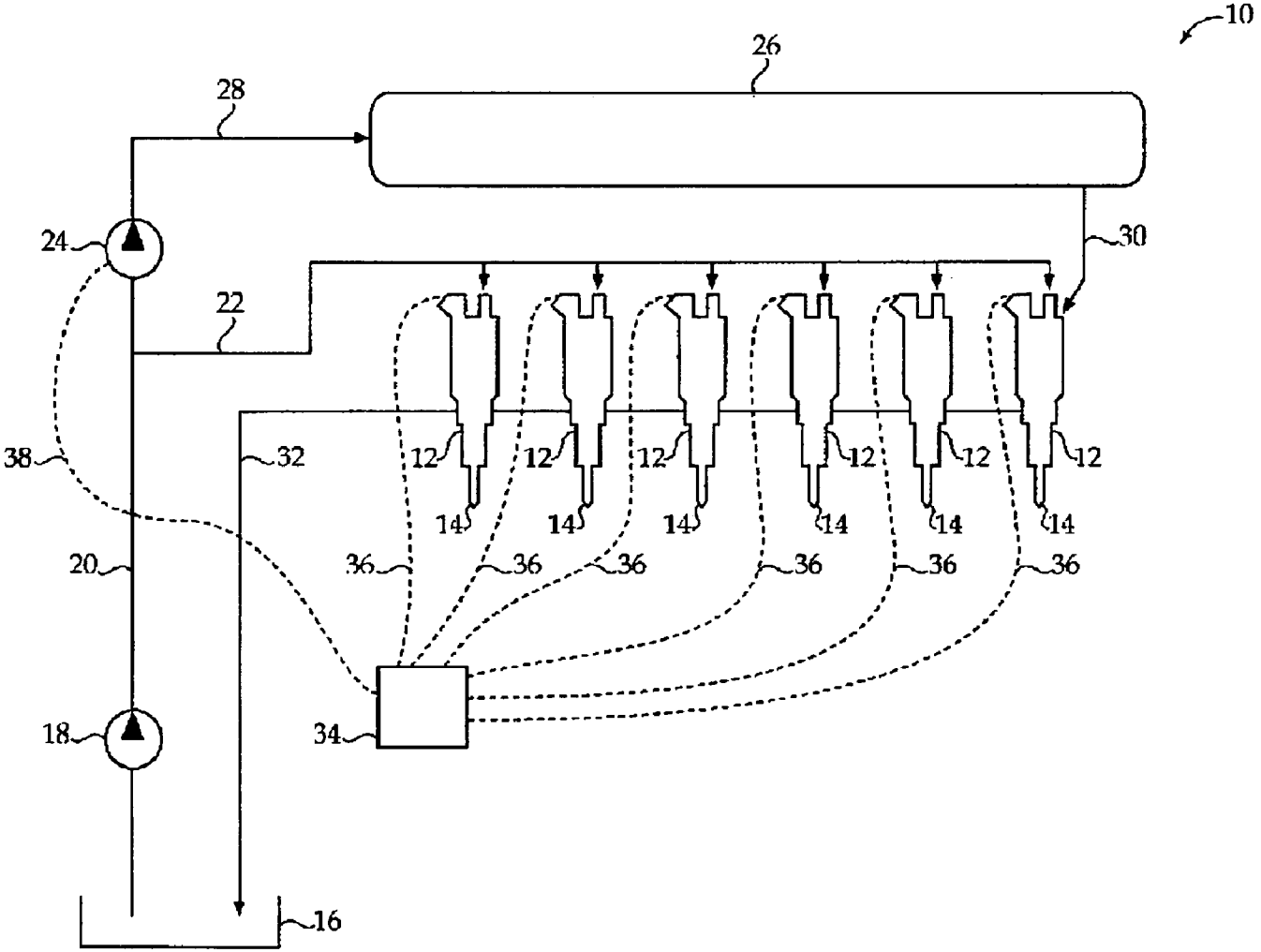
FIG. 1 is a schematic view of an exemplary embodiment of a fuel system, according to the present disclosure.

Referring generally to FIG. 1, an exemplary embodiment of a fuel system 10 may include a plurality of fuel injectors 12 positioned for direct injection of fuel into respective engine cylinders (not shown). More specifically, a fuel injector nozzle tip 14 of each fuel injector 12 may be positioned for injection of fuel within a respective cylinder of a compression ignition engine. Generally, fuel may be drawn from a fuel tank 16 by a low pressure transfer pump 18 and, from there, may be routed along a low pressure line 20 to one of a fuel cooling line 22 or a high pressure pump 24. The high pressure pump 24 may fluidly supply a common rail 26, or fuel rail, via a high pressure rail supply line 28, as shown. The high pressure fuel from the common rail 26 may then be delivered to the engine cylinders using fuel injectors 12, which are each supplied with high pressure fuel via an individual branch passage 30 (only one shown). Each fuel injector 12 may also include a drain outlet, which is fluidly connected to the fuel tank 16 via a drain line 32.

According to one embodiment, the fuel system 10 may be controlled by an electronic controller 34. The electronic controller 34 may be of standard design and may generally include a processor, such as for example a central processing unit, a memory, and an input/output circuit that facilitates communication internal and external to the electronic controller 34. The central processing unit may control operation of the electronic controller 34 by executing operating instructions, such as, for example, programming code stored in memory, wherein operations may be initiated internally or externally to the electronic controller 34. A control scheme may be utilized that monitors outputs of systems or devices, such as, for example, sensors, actuators or control units, via the input/output circuit to control inputs to various other systems or devices. For instance, the electronic controller 34 may be in control communication with each of the fuel injectors 12 or, more specifically, actuators thereof via communication lines 36 to deliver the required amount of fuel at the correct time. Further, the electronic controller 34 may communicate control signals to high pressure pump 24 via a communication line 38 to control pressure and output of high pressure pump 24 to common rail 26.

Figure 2:
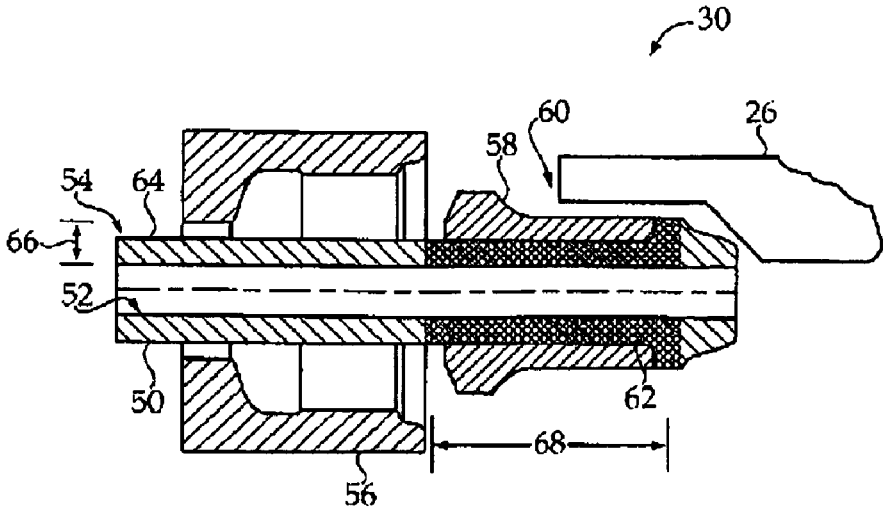
FIG. 2 is a sectioned view through a high pressure fuel line for the fuel system of FIG. 1, according to one embodiment of the present disclosure.

Turning now to FIG. 2, a portion of the individual branch passage 30 is shown. Specifically, a portion of the branch passage 30 including a connection of a high pressure fuel line 50, such as a metallic fuel line, to the common rail 26 is depicted. As shown, the high pressure fuel line 50, including an internal surface 52 and an external surface 54, may include a connection nut 56 positioned around the external surface 54 for connection of the high pressure fuel line 50 to the common rail 26. Specifically, the connection nut 56 may be threaded, or otherwise attached, to a port of the common rail 26. According to one embodiment, the high pressure fuel line 50 may also include a load collar 58 positioned at a connection end 60 of the branch passage 30. Although a specific embodiment is shown, it should be appreciated that alternative connections are also contemplated.

The high pressure fuel line 50 may be representative of one embodiment of a fuel system component, or metallic fuel system component, having indirect laser induced residual stress. Specifically, a compressive residual stress region 62 may be induced using a laser shock peening process, and may extend through a metallic wall 64 of the high pressure fuel line 50 from the external surface 54 through the internal surface 52. The laser shock peening process, discussed later in greater detail, may include directing a plurality of laser pulses at the external surface 54 of the high pressure fuel line 50 and, as a result, transmitting a plurality of laser shock waves through the metallic wall 64 from the external surface 54 to the internal surface 52. Preferably, the metallic wall 64, at least at the compressive residual stress region 62, has a first wall thickness 66 of less than about three millimeters. According to the exemplary embodiment, it may be desirable for the compressive residual stress region 62 to extend a length 68 corresponding to a length of the load collar 58.

Figure 3:
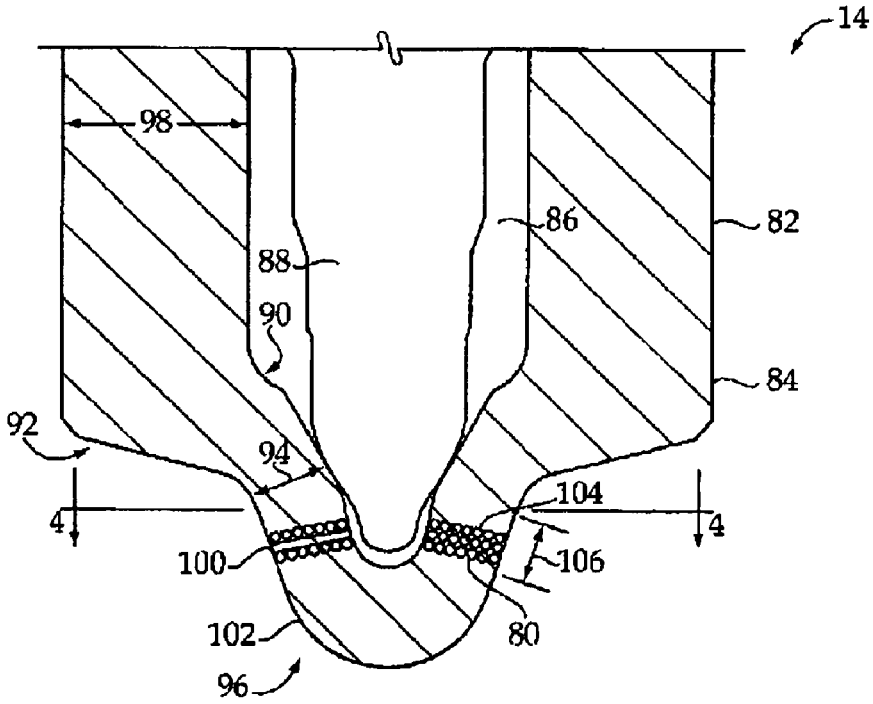
FIG. 3 is a sectioned view through a fuel injector nozzle tip for the fuel system of FIG. 1, according to another embodiment of the present disclosure.

Additional metallic fuel system components, such as, for example, the fuel injector nozzle tip 14, may also include indirect laser induced residual stress. Specifically, as shown in FIG. 3, the fuel injector nozzle tip 14 may include a compressive residual stress region shown generally at 80. The fuel injector nozzle tip 14, according to the exemplary embodiment, may generally include a component body 82 having a metallic wall 84 defining a nozzle chamber 86. A valve member 88 may be positioned within the nozzle chamber 86 and may be movable with respect to the component body 82. The component body 82, having an internal surface 90 and an external surface 92, may have a first wall thickness 94 at an injection end 96 of the fuel injector nozzle tip 14, and alternative thicknesses, such as a second wall thickness 98, elsewhere. The injection end 96, as should be appreciated, may include a plurality of nozzle orifices 100 that may open within an engine cylinder, as described above.

The compressive residual stress region 80 may also be induced using a laser shock peening process, and may extend through the metallic wall 84 of the fuel injector nozzle tip 14 from the external surface 92 through the internal surface 90. The laser shock peening process may include directing a plurality of laser pulses at the external surface 92 of the fuel injector nozzle tip 14 and, as a result, transmitting a plurality of laser shock waves through the metallic wall 84 from the external surface 92 to the internal surface 90. Preferably, as explained later in greater detail, the first wall thickness 94, at the injection end 96, is less than about three millimeters. According to one embodiment, a manufacturing method for the fuel injectors 12 may include transmitting a plurality of laser shock waves about a circumference 102 of the fuel injector nozzle tip 14. Specifically, the resulting compressive residual stress region 80 may be induced to define a continuous band 104 about the circumference 102 of the fuel injector nozzle tip 14. The continuous band 104 may have a width 106 that is sufficient to encompass the one or more nozzle orifices 100 that may be bored through the metallic wall 84 before or after the laser shock peening process.

Figure 4:
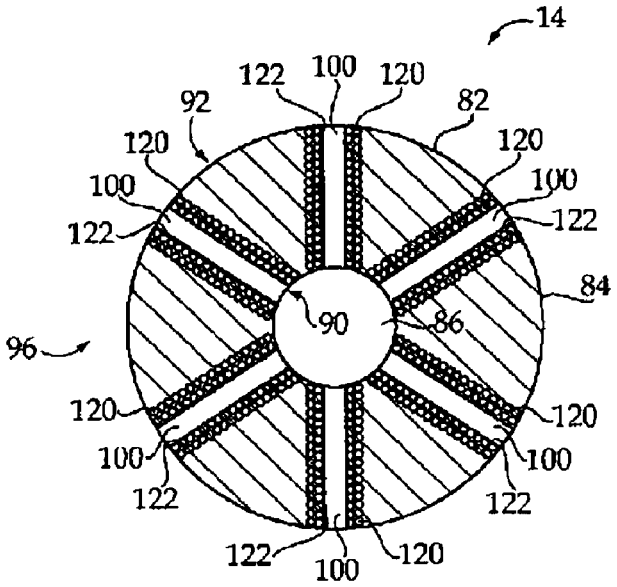
FIG. 4 is a sectioned view taken along lines 4-4 of FIG. 3, according to a specific embodiment of the present disclosure.

According to an alternative embodiment, as shown in FIG. 4, the fuel injector nozzle tip 14 may include a plurality of discontinuous compressive residual stress regions 120. Specifically, during manufacture, the plurality of nozzle orifices 100 may be drilled through the metallic wall 84 of the fuel injector nozzle tip 14 before the compressive residual stress is induced. After the nozzle orifices 100 have been drilled, each compressive residual stress region 120 may be induced by directing a plurality of laser pulses about a circumference 122 of each nozzle orifice 100. As described above, the resulting laser shock waves may be transmitted through the metallic wall 84 from the external surface 92 through the internal surface 90. As a result, portions of the internal surface 90, which may be subject to extreme fluctuations in pressure and flow, may be strengthened by the compressive residual stress regions 120.

Figure 5:
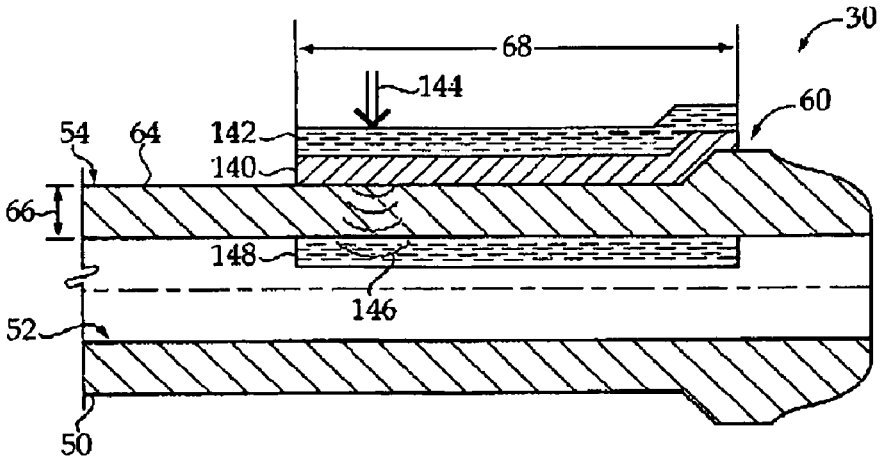
FIG. 5 is a sectioned view through the high pressure fuel line of FIG. 2, illustrating an exemplary laser shock peening process, according to the present disclosure.

Turning now to FIG. 5, an exemplary method of indirectly inducing compressive residual stress in an internal surface of a metallic fuel system component is described with respect to the high pressure fuel line 50, described above. According to the exemplary embodiment, it may be desirable to induce compressive residual stress in the internal surface 52 of the connection end 60 of the high pressure fuel line 50. As such, a target area, defined by the length 68, may be coated with a sacrificial wear material 140, such as black paint or tape. A translucent layer 142, which may include water, may be provided over the sacrificial wear material 140. When a laser (not shown) produces a laser pulse 144 that is directed to the external surface 54 of the high pressure fuel line 50, the sacrificial wear material 140 may be exploded to produce a plasma (not shown). The plasma, which may be confined by the translucent layer 142, expands to cause a laser shock wave 146 to be transmitted through the wall thickness 66 of the high pressure fuel line 50 from the external surface 54 through the internal surface 52.

The pressure of the laser shock wave 146 is greater than the yield strength of the metallic wall 64 and, as such, deforms the high pressure fuel line 50 to a depth where the pressure is no longer greater than the yield strength. Preferably, the wall thickness 66 of the high pressure fuel line 50 is less than about 3 millimeters and, as such, the laser shock wave 146 will deform the metallic wall 64 from the external surface 54 through the internal surface 52, thus developing indirectly induced compressive residual stress at the internal surface 52 of the high pressure fuel line 50. To receive, and/or absorb, the laser shock wave 146 and prevent a tensile wave from traveling back in a reflected direction to effectively undo the compressive residual stress, a shock absorption medium 148 may be coupled with the internal surface 52. According to one embodiment, the shock absorption medium 148 may include a liquid, such as water. Alternatively, the shock absorption medium 148 may include a rubber, or other elastic material. However, any material useful to reduce the occurrence of reflected waves traveling back through the metallic wall 64 is contemplated.

The compressive residual stress may be induced in only portions, and not all, of a fuel system component. Specifically, compressive residual stress may be induced only in areas of the fuel system component that may be subject to extreme fatigue inducing stresses. Such areas may include internal surfaces of the fuel system components, as described above, that, due to their size and/or location, may be inaccessible. As such, the compressive residual stress regions may be indirectly induced at the internal surfaces by transmitting laser shock waves through the component from the external surface, which may or may not need strengthening, through the internal surface. Therefore, it may be desirable for such components to have a wall thickness of less than about three millimeters. Further, the compressive residual stress may be induced using a computer controlled process for directing a plurality, or pattern, of laser shock pulses at the external surface to achieve a desired stress region in the internal surface.

The compressive residual stress may be induced during a manufacturing process of the fuel system component using the laser peening process described above. Further, additional surface finishing, or surface treatment, processes may be performed on the internal surface, or external surface, prior to compressive residual stress being induced. Such processes are known, and may include, for example, an autofrettaging process or a heat treatment. For example, it may be desirable to induce compressive residual stress after a heat hardening treatment has been performed, since a heat treatment may relieve any previously induced compressive residual stress. Although specific examples are given, it should be appreciated that any surface treatments or finishing processes may be used in combination with the laser peening process described herein.

INDUSTRIAL APPLICABILITY

The present disclosure may find potential application to fuel systems for internal combustion engines. More particularly, the present disclosure may be applicable to metallic fuel system components that are subject to cyclic stresses, vibrations, and other fatigue causing stresses. Further, the present disclosure may be applicable to surfaces, such as internal surfaces, of such fuel system components that are subject to crack initiation and propagation when the component is loaded in a cyclic way or otherwise fatigued. Yet further, the present disclosure may be applicable to such internal surfaces that may, due to size and/or location, be inaccessible by conventional surface hardening or strengthening methods.

Many fuel system components may be subject to cyclic stresses, high fluid pressures, vibrations, and other fatigue causing stresses. For example, and referring generally to FIGS. 1-5, the fuel injector nozzle tip 14 of the fuel injector 12, which generally includes the plurality of nozzle orifices 100, may experience extreme fluctuations in pressure and flow forces, especially at the internal surface 90 thereof, during and between injection events. In another example, high pressure fuel line 50 may experience substantial stress due to increased fluid operating pressures, and may also experience other fatigue inducing stresses, such as bending, due to engine vibrations and the like. Typically, the fatigue life of such surfaces may be increased using one or more strengthening surface treatments, such as mechanical shot peening processes, autofrettaging, grinding operations, carburizing heat treatments, ultrasonic impact treatments, and other similar surface treatments. However, due to the inaccessibility of the internal surfaces of such components, the conventional surface strengthening, or hardening, processes are not available.

The method of indirectly inducing compressive residual stress in an internal surface of a fuel system component, as described herein, may be used to improve the fatigue strength of such inaccessible surfaces. Specifically, a high power laser may be used to induce compressive residual stress in an internal surface of a component by directing laser shock pulses at an external surface of the component. As a result, laser shock waves may be transmitted through a component wall, which is preferably less than about three millimeters thick, from the external surface through the internal surface. For example, such a process may be used to indirectly induce a compressive residual stress region 62 in the internal surface 52 of the high pressure fuel line 50 that may extend a length 68 corresponding to a length of the load collar 58. In addition, the internal surface 90 of the fuel injector nozzle tip 14 may include compressive residual stress regions 80 or 120 that define the plurality of nozzle orifices 100. Although the indirect laser induced residual stress is depicted at particular areas of the exemplary fuel system components 50 and 14, it should be appreciated that it may be useful to induce compressive residual stress at various internal surface locations of a variety of fuel system components.

Specifically, the method of inducing indirect residual stress, as described herein, provides a method for inducing high levels of compressive residual stress in surfaces and materials that may be prone to crack formation and which are not accessible to traditional methods of inducing compressive residual stress. By irradiating a laser light pulse on an external surface of a component to induce indirect laser induced residual stress in an inaccessible internal surface, the present disclosure aims to reduce the risk of crack formation in fuel system components. Further, the present disclosure provides a method of reducing crack formation in remanufactured fuel system components. Finally, the present disclosure may allow fuel injectors to operate at high pressures, such as pressures greater than about 300 MPa, with a manageable risk of crack formation in the nozzle tip and other fuel system components.

It should be understood that the above description is intended for illustrative purposes only, and is not intended to limit the scope of the present disclosure in any way. Thus, those skilled in the art kill appreciate that other aspects of the disclosure can be obtained from a study of the drawings, the disclosure and the appended claims.

What is claimed is:

1. A metallic fuel system component having an internal surface and an external surface, made by the steps of:

Indirectly inducing compressive residual stress in only a portion, which is less than all of the internal surface of the metallic fuel component by:

Laser shock peening from the external surface through the internal surface; and

The laser shock peening includes transmitting shock waves through the metallic fuel system component from the external surface to the internal surface with a pressure that exceeds a yield strength of the metallic fuel system component through the internal surface such that only the portion of the metallic fuel system includes compressive residual stress through the entire portion from external surface to internal surface.

2. The metallic fuel system component of claim 1, wherein the inducing step further includes receiving the shock wave in a shock absorption medium coupled with the internal surface to prevent a tensile wave from traveling back in a reflected direction to effectively undo the compressive residual stress.

3. The metallic fuel system component of claim 2, wherein the steps of making the metallic fuel system component further include performing a surface finishing process on the internal surface prior to the inducing step.

4. The metallic fuel system component of claim 3, wherein the performing step further includes autofrettaging the internal surface of the metallic fuel system component.

5. The metallic fuel system component of claim 2, wherein the metallic fuel system component includes a fuel injector nozzle tip.

6. The metallic fuel system component of claim 5, wherein the transmitting step further includes transmitting a plurality of shock waves about a circumference of a nozzle orifice.

7. The metallic fuel system component of claim 5, wherein the transmitting step further includes:

transmitting a plurality of shock waves about a circumference of the fuel injector nozzle tip to define a compressive residual stress region; and boring a nozzle orifice through the compressive residual stress region after transmitting the shock waves.

8. The metallic fuel system component of claim 2, wherein the metallic fuel system component includes a high pressure fuel line.

9. The metallic fuel system component of claim 8, wherein the transmitting step further includes transmitting a plurality of shock waves about an end of the high pressure fuel line, the end configured for connection with a fuel rail.

10. A method of indirectly inducing compressive residual stress in an internal surface of a fuel system component, comprising:

directing a laser pulse at an external surface of the fuel system component;

exploding sacrificial material to produce a plasma responsive to the laser pulse;

expanding the plasma to transmit a shock wave through a wall thickness of the fuel system component from the external surface through the internal surface with a pressure that exceeds a yield strength of the metallic fuel system component through the internal surface; and receiving the shock wave in a shock absorption medium coupled with the internal surface to prevent a tensile wave from traveling back in a reflected direction to effectively undo the compressive residual stress.

11. The method of claim 10, wherein the transmitting step further includes transmitting a plurality of shock waves about a circumference of a nozzle orifice of a fuel injector nozzle tip.

12. The method of claim 10, wherein the transmitting step includes transmitting a plurality of shock waves about a circumference of a fuel injector nozzle tip to define a compressive residual stress region; and boring a nozzle orifice through the compressive residual stress region after transmitting the shock waves.

13. The method of claim 10, wherein the transmitting step further includes transmitting a plurality of shock waves about an end of a high pressure fuel line, the end configured for connection with a fuel rail.

14. The method of claim 10, wherein the transmitting step includes transmitting a plurality of shock waves about a circumference of a fuel injector nozzle top to define a compressive residual stress region; and boring a nozzle orifice through the compressive residual stress region before transmitting the shock waves.

* * * * *

UNITED STATES PATENT AND TRADEMARK OFFICE

CERTIFICATE OF CORRECTION

PATENT NO. : 8,322,004 B2
APPLICATION NO. : 12/432072
DATED : December 4, 2012
INVENTOR(S) : Lewis et al.

It is certified that error appears in the above-identified patent and that said Letters Patent is hereby corrected as shown below:

Title Page, Column 1, Item 73 (Assignee), line 1, delete "Caterpilar Inc.," and insert -- Caterpillar Inc., --.

In the Specification,

Column 6, line 40, delete "kill" and insert -- will --.

In the Claims,

Column 6, line 46, in Claim 1, delete "Indirectly" and insert -- indirectly --.

Column 6, line 49, in Claim 1, delete "Laser" and insert -- laser --.

Column 6, line 51, in Claim 1, delete "The" and insert -- the --.

Signed and Sealed this
First Day of September, 2015

Michelle K. Lee

Michelle K. Lee
*Director of the United States Patent and Trademark Office*